US007233292B2

(12) United States Patent
Chan

(10) Patent No.: US 7,233,292 B2
(45) Date of Patent: Jun. 19, 2007

(54) ANTENNA DEVICE HAVING ROTATABLE STRUCTURE

(75) Inventor: Yat To Chan, Tauyuan Hsien (TW)

(73) Assignee: Joymax Electronics Co., Ltd., Chongli Gonyeh Chu, Chongli, Tauyuan Hsien (TW)

( * ) Notice: Subject to any disclaimer, the term of this patent is extended or adjusted under 35 U.S.C. 154(b) by 203 days.

(21) Appl. No.: 11/131,774

(22) Filed: May 17, 2005

(65) Prior Publication Data

US 2006/0273979 A1 Dec. 7, 2006

(51) Int. Cl.
*H01Q 1/24* (2006.01)

(52) U.S. Cl. ..... 343/702; 343/906

(58) Field of Classification Search ..... 343/702, 343/880, 882, 906; 439/916
See application file for complete search history.

(56) References Cited

U.S. PATENT DOCUMENTS 5,218,370 A * 6/1993 Blaese ..... 343/702
5,422,651 A * 6/1995 Chang ..... 343/749
5,440,315 A * 8/1995 Wright et al. ..... 343/702
5,576,720 A * 11/1996 Gorenz et al. ..... 343/702
6,341,217 B1 1/2002 Wong ..... 455/90
6,518,928 B1 2/2003 Sheu ..... 343/702
6,710,747 B1 * 3/2004 Chang ..... 343/702
7,046,212 B2 * 5/2006 Tai et al. ..... 343/882

* cited by examiner

*Primary Examiner*—Tho Phan
(74) *Attorney, Agent, or Firm*—Charles E. Baxley

(57) ABSTRACT

An antenna device includes a coupler rotatably attaching to a support device, a connector rotatably attached to the coupler with a pivot axle and having an extension, and having a stop. An antenna member includes a bore formed in one end for rotatably receiving the extension of the connector. The antenna member includes a stop for engaging with the stop of the connector, and for limiting the antenna member to rotate relative to the connector. The connector includes one or more projections extended into a peripheral groove, and the antenna member includes one or more anchoring members for engaging with the projection of the connector, to position the antenna member to the connector at selected angular position.

7 Claims, 4 Drawing Sheets

ANTENNA DEVICE HAVING ROTATABLE STRUCTURE

BACKGROUND OF THE INVENTION

1. Field of the Invention

The present invention relates to an antenna device, and more particularly to an antenna device having a rotatable structure for allowing the antenna device to be freely rotated relative to the support object or device to any angular direction.

2. Description of the Prior Art

Typical antenna devices comprise an antenna housing or member solidly attached or secured onto a telecommunicating facility or the other support objects or devices, and some of the antenna housings or members may include a telescopic structure for selectively extending out of the telecommunicating facility or the other support objects or devices.

For example, U.S. Pat. No. 6,341,217 to Wong discloses one of the typical portable telephones including a shielded transmission antenna that is solidly secured to the typical portable telephone, and may not be extended relative to the typical portable telephone, such that the typical portable telephones may not easily receive telecommunicating signals.

U.S. Pat. No. 6,518,928 to Sheu discloses another typical electric facility including an antenna device rotatably secured to the typical electric facility, for being rotated relative to the typical electric facility to various angular directions. However, the antenna device of the typical electric facility may only be rotated relative to the typical electric facility in two directions only, and may not be freely rotated relative to the typical electric facility to any suitable or selected directions.

The present invention has arisen to mitigate and/or obviate the afore-described disadvantages of the conventional antenna devices for telecommunicating facilities.

SUMMARY OF THE INVENTION

The primary objective of the present invention is to provide an antenna device including a rotatable structure for allowing the antenna device to be freely rotated relative to the support object or device to any angular direction.

In accordance with one aspect of the invention, there is provided a antenna device comprising a coupler including a first end for rotatably attaching to a support device, and including a second end, a connector including a first end rotatably attaching to the second end of the coupler with a pivot axle, and including an extension extended from a second end thereof, the connector includes one or more peripheral ribs extended from the extension thereof and formed and defined by one or more peripheral grooves, and includes a stop extended from the peripheral rib thereof, and an antenna member includes a first end having a bore formed therein for rotatably receiving the extension of the connector, and includes one or more peripheral swellings extended into the bore thereof, and formed and defined by one or more peripheral channels, for engaging with the peripheral groove and the peripheral rib of the connector respectively, and for rotatably coupling the first end of the antenna member to the extension of the connector, the antenna member includes a stop extended into the peripheral channel thereof, for engaging with the stop of the connector, and for limiting the antenna member to rotate relative to the connector, and for preventing the antenna member from being over rotated relative to the connector.

The connector includes one or more projections extended into the peripheral groove thereof, and the antenna member includes one or more anchoring members provided therein, for engaging with the projection of the connector, and for anchoring and positioning the antenna member to the connector at any selected or predetermined angular positions.

The antenna member includes one or more cavities formed in the peripheral swelling thereof, for selectively receiving the projection of the connector, and for stably anchoring and positioning the antenna member to the connector at selected angular position.

The connector includes one or more slits formed in the extension thereof, for increasing a resilience of the extension of the connector. The connector includes an aperture formed therein, and a barrel received in the aperture thereof, to reinforce the extension of the connector.

The antenna member includes a covering engaged onto the first end thereof, for reinforcing the first end thereof. The coupler includes one or more slots formed in the second end thereof to form one or more spring arms.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
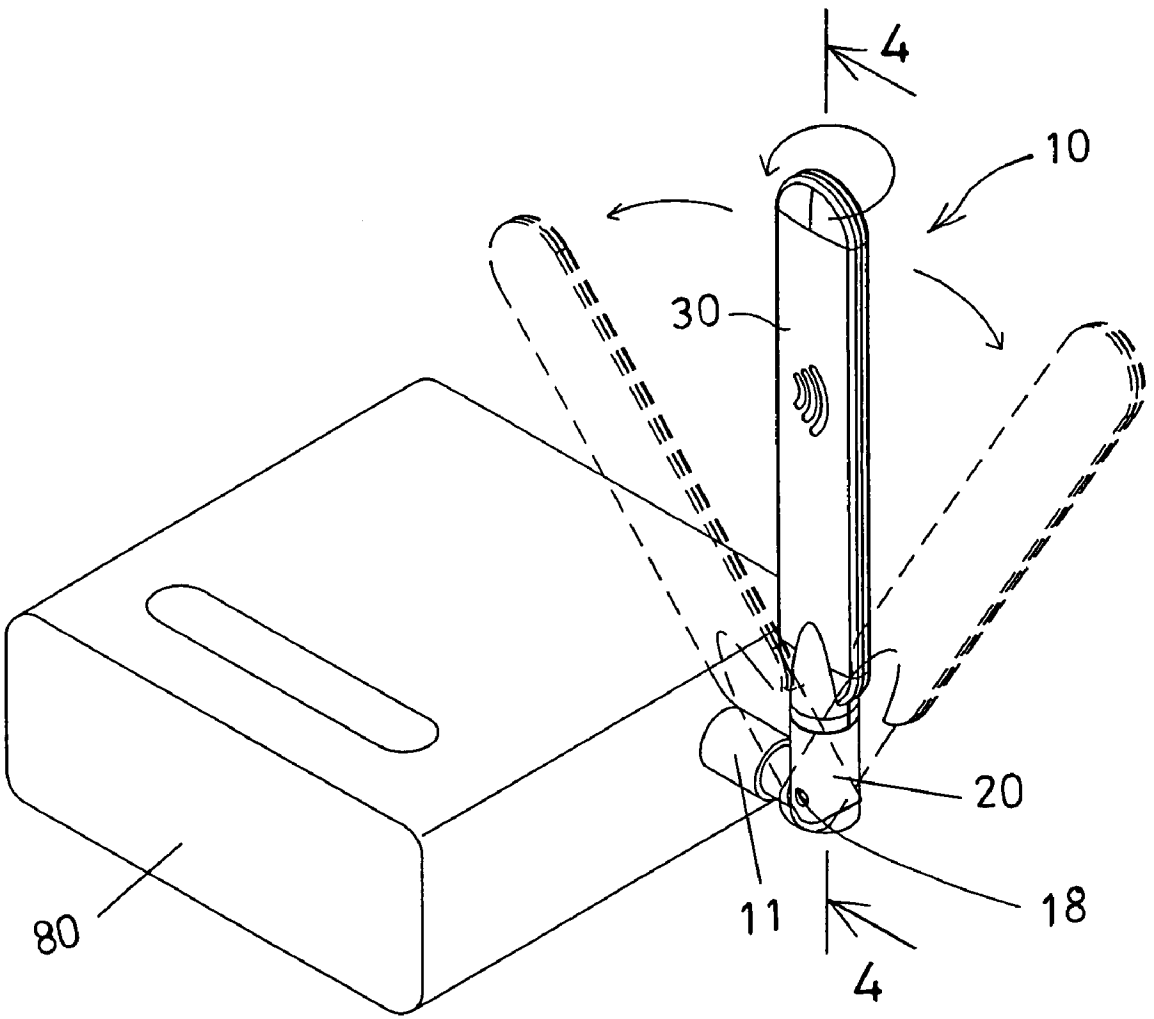
FIG. 1 is a perspective view illustrating an attachment of an antenna device in accordance with the present invention onto a telecommunicating facility or electric facility or other support objects or devices.
Figures 2, 3:
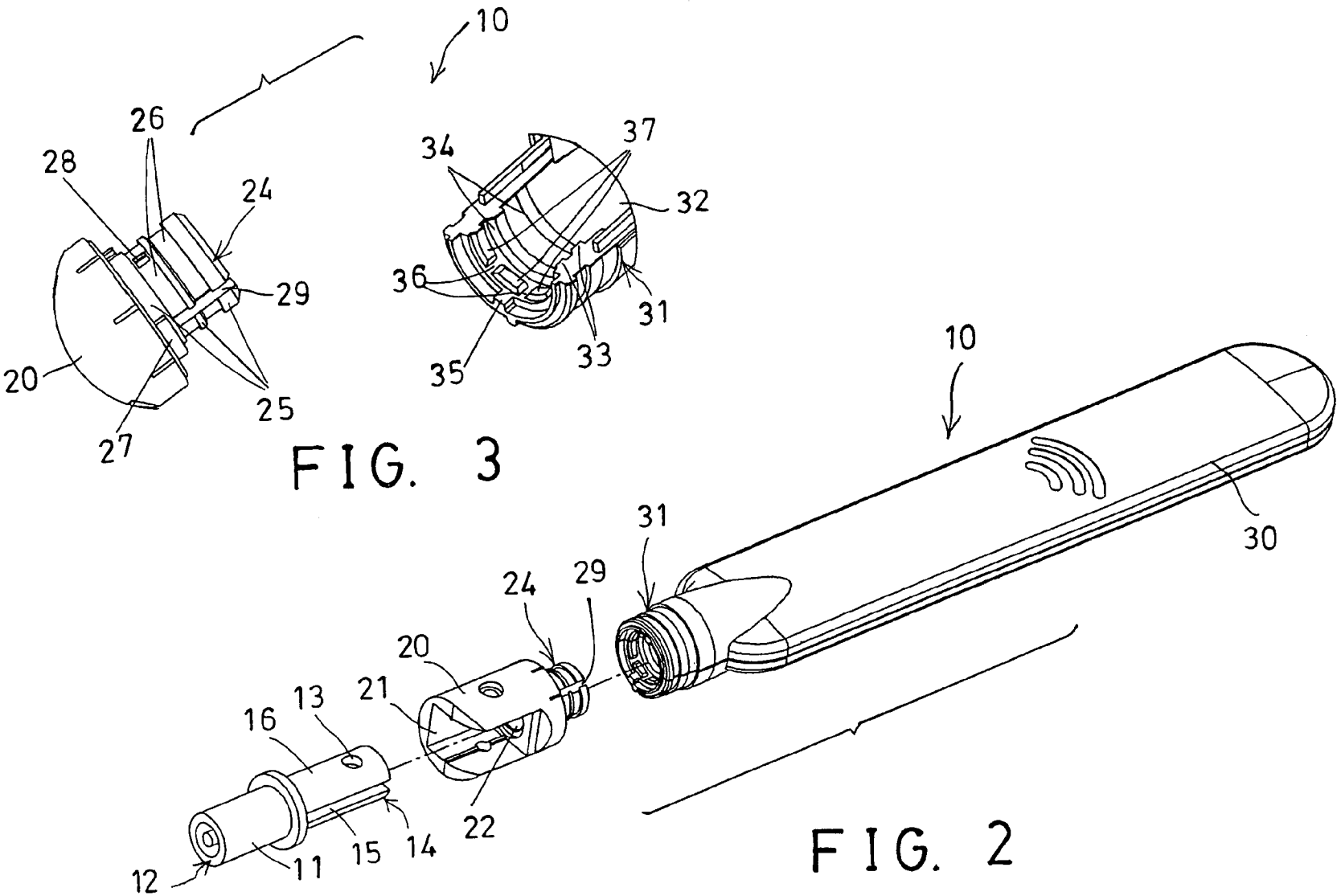
FIG. 2 is a partial exploded view of the antenna device.
FIG. 3 is an enlarged partial exploded view of the antenna device.
Figure 4:
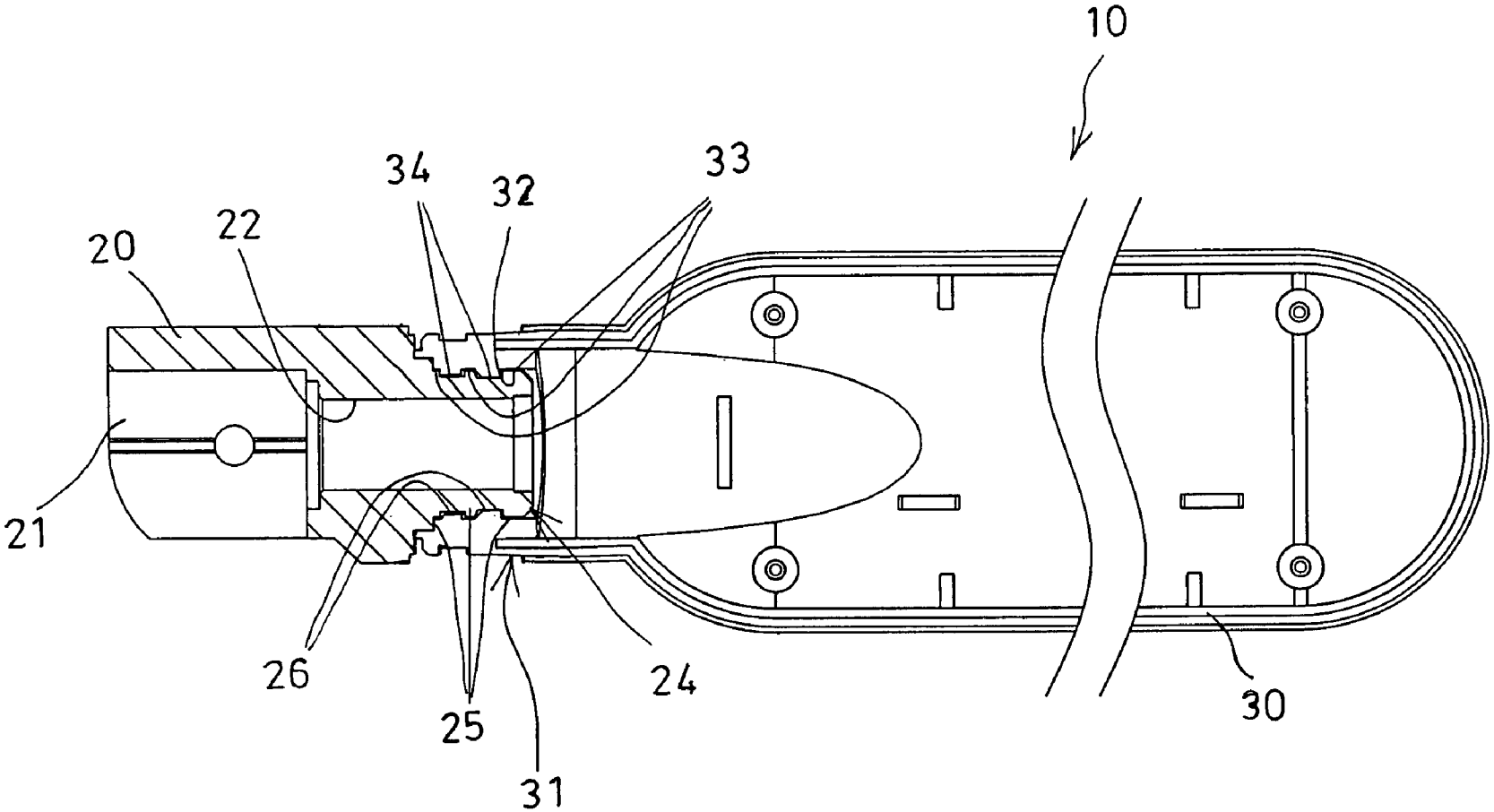
FIG. 4 is a partial cross sectional view of the antenna device, taken along lines 4—4 of FIG. 1.

Referring to the drawings, and initially to FIGS. 1 and 2, an antenna device 10 in accordance with the present invention is provided or arranged for pivotally or rotatably attached to a telecommunicating facility or electric facility or other support objects or devices 80, and comprises a coupler 11 including one end 12 for pivotally or rotatably plugging or attaching to the telecommunicating facility or support device 80, and including an orifice 13 formed in the other end 14 thereof, and preferably further including one or more slots 15 formed in the other end 14 thereof to form one or more spring arms 16.

Figure 5:
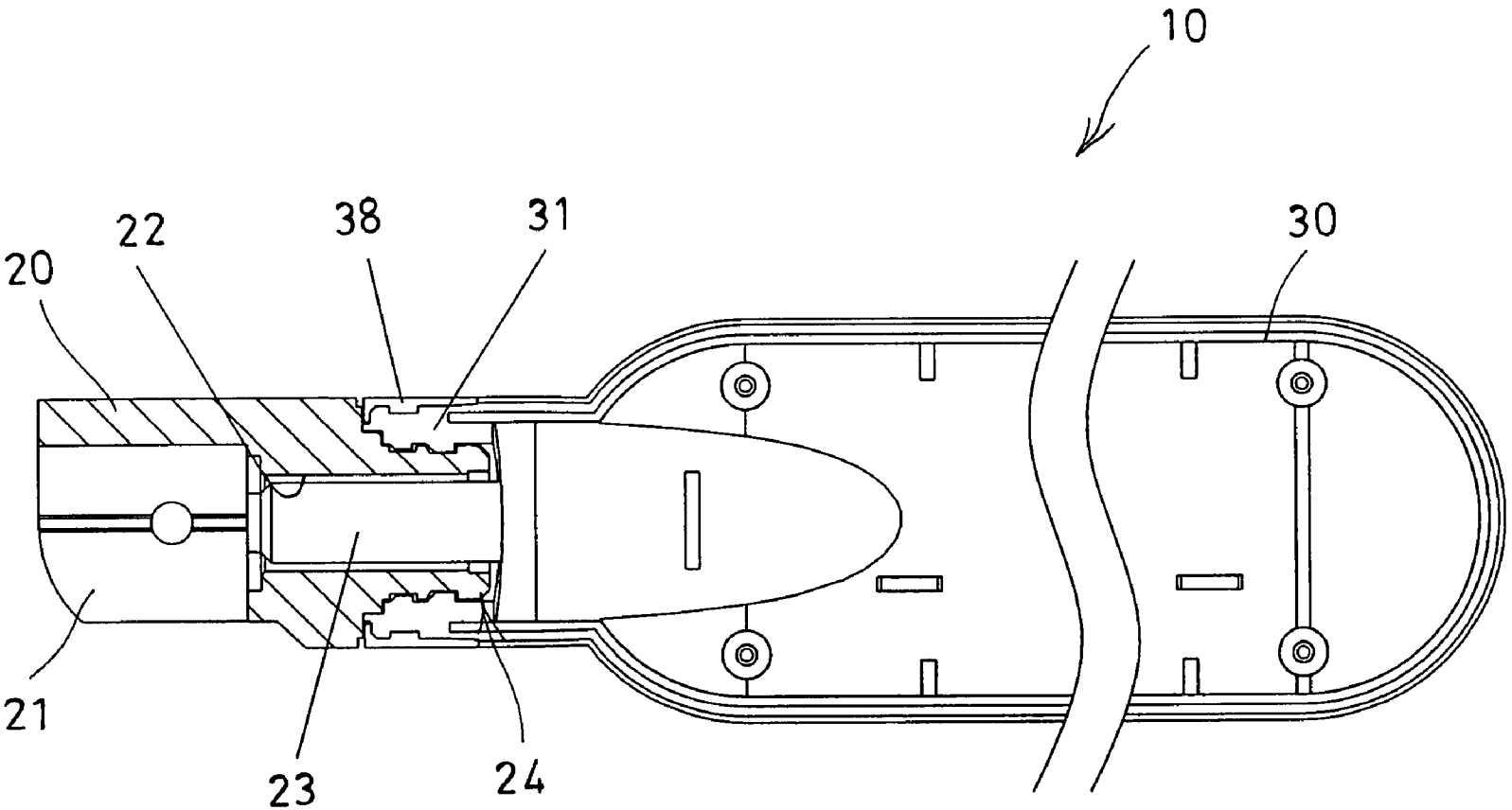
FIG. 5 is a partial cross sectional view similar to FIG. 4, illustrating the other arrangement of the antenna device.

A connector 20 includes a chamber 21 formed therein, such as formed in one end thereof, for rotatably receiving or attaching the other end 14 of the coupler 11, and may be pivotally or rotatably coupled to the coupler 11 with a pivot axle 18 (FIG. 1), to allow the connector 20 to be rotated relative to the coupler 11 about the pivot axle 18. The connector 20 includes an aperture 22 formed therein and communicating with the chamber 21 thereof, for selectively or optionally receiving such as a protective barrel 23 therein (FIG. 5), and/or for receiving electric cables or wires (not shown) therein, and includes an extension 24 extended therefrom, such as extended from the other end thereof, opposite to the chamber 21 or the one end thereof. The protective barrel 23 may be used to reinforce the extension 24 of the connector 20.

As best shown in FIG. 3, the connector 20 includes one or more peripheral ribs 25 extended radially and outwardly from the extension 24 thereof, and formed or defined between one or more peripheral grooves 26, and includes a stop 27 extended radially and outwardly from one of the peripheral ribs 25 thereof, and further includes one or more projections 28 extended into or within one of the peripheral grooves 26 thereof. It is further preferable that the extension 24 of the connector 20 includes one or more slits 29 formed therein for increasing the resilience of the extension 24 of the connector 20.

An antenna housing or member 30 includes one end 31 having a bore 32 formed therein for rotatably receiving the extension 24 of the connector 20, and includes one or more peripheral swellings 33 extended radially and inwardly into the bore 32 thereof, and formed or defined between one or more peripheral channels 34, for slidably or rotatably engaging with the corresponding peripheral grooves 26 and the peripheral ribs 25 of the connector 20 respectively, and thus for rotatably coupling the one end 31 of the antenna member 30 to the extension 24 of the connector 20.

The antenna member 30 further includes a stop 35 extended into or within one of the peripheral channels 34 thereof, for engaging with the corresponding stop 27 of the connector 20, and thus for limiting the antenna member 30 to rotate relative to the connector 20, and for preventing the antenna member 30 from being over rotated relative to the connector 20, to prevent the electric cables or wires that are coupled between the antenna member 30 and the connector 20 from being twisted.

The antenna member 30 further includes one or more cavities 36 formed in one of the peripheral swellings 33 thereof, and formed or defined by one or more anchor members 37, for selectively receiving the projections 28 of the connector 20, and thus for stably anchoring or positioning the antenna member 30 to the connector 20 at selected or predetermined angular positions.

The antenna member 30 may further include a protective sleeve or covering 38 (FIG. 5) engaged onto the one end 31 thereof, for shielding or protecting the one end 31 of the antenna member 30 and the extension 24 of the connector 20, the protective sleeve or covering 38 may further be used to reinforce or to strengthen the one end 31 of the antenna member 30 and/or the extension 24 of the connector 20.

The antenna member 30 may thus be rotated relative to the connector 20 at selected or predetermined angular positions, the connector 20 may be rotated relative to the coupler 11, and the coupler 11 may be freely rotated relative to the telecommunicating facility or support device 80 to any suitable angular positions, such that the antenna member 30 may be freely rotated relative to the telecommunicating facility or support device 80 to any suitable angular positions.

Accordingly, the antenna device in accordance with the present invention includes a rotatable structure for allowing the antenna device to be freely rotated relative to the support object or device to any angular direction.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An antenna device comprising:

a coupler including a first end for rotatably attaching to a support device, and including a second end, a connector including a first end rotatably attaching to said second end of said coupler with a pivot axle, and including an extension extended from a second end thereof, said connector including at least one peripheral rib extended from said extension thereof and formed and defined by at least one peripheral groove, and including a stop extended from said at least one peripheral rib thereof, and an antenna member including a first end having a bore formed therein for rotatably receiving said extension of said connector, and including at least one peripheral swelling extended into said bore thereof, and formed and defined by at least one peripheral channel, for engaging with said at least one peripheral groove and said at least one peripheral rib of said connector respectively, and for rotatably coupling said first end of said antenna member to said extension of said connector, said antenna member including a stop extended into said at least one peripheral channel thereof, for engaging with said stop of said connector, and for limiting said antenna member to rotate relative to said connector, and for preventing said antenna member from being over rotated relative to said connector.

2. The antenna device as claimed in claim 1, wherein said connector includes at least one projection extended into said at least one peripheral groove thereof, and said antenna member includes at least one anchoring member provided therein, for engaging with said at least one projection of said connector, and for anchoring and positioning said antenna member to said connector at selected angular position.

3. The antenna device as claimed in claim 2, wherein said antenna member includes at least one cavity formed in said at least one peripheral swelling thereof, for selectively receiving said at least one projection of said connector, and for stably anchoring and positioning said antenna member to said connector at selected angular position.

4. The antenna device as claimed in claim 1, wherein said connector includes at least one slit formed in said extension thereof, for increasing a resilience of said extension of said connector.

5. The antenna device as claimed in claim 1, wherein said connector includes an aperture formed therein, and a barrel received in said aperture thereof, to reinforce said extension of said connector.

6. The antenna device as claimed in claim 1, wherein said antenna member includes a covering engaged onto said first end thereof, for reinforcing said first end thereof.

7. The antenna device as claimed in claim 1, wherein said coupler includes at least one slot formed in said second end thereof to form at least one spring arm.

* * * * *